United States Patent [19]

Sell

[11] Patent Number: 4,810,560

[45] Date of Patent: Mar. 7, 1989

[54] BATTING BOX

[75] Inventor: Charles Sell, Fairfax, Va.

[73] Assignee: JOX Corporation, Manassas Park, Va.

[21] Appl. No.: 130,217

[22] Filed: Dec. 8, 1987

[51] Int. Cl.[4] ..... A63B 71/00

[52] U.S. Cl. ..... 428/192; 428/17; 428/88; 428/423.9; 428/492; 429/157; 429/177; 273/25

[58] Field of Search ..... 273/25, 26 A, 26 B, 273/26 C, 26 D, 26 E, 183 A, DIG. 13; 428/2, 17, 423.9, 492, 192, 88, 130, 157, 177

[56] References Cited

U.S. PATENT DOCUMENTS

| | | | |
|---|---|---|---|
| 1,939,846 | 12/1933 | Fenton | 428/17 |
| 1,949,068 | 2/1934 | Achterhof | 428/17 |
| 3,489,710 | 1/1970 | Bonotto | 524/525 |
| 3,597,297 | 8/1971 | Buchholtz et al. | 428/17 |
| 3,806,486 | 4/1974 | Endriss et al. | 428/423.9 |
| 4,067,757 | 1/1978 | Layman | 428/17 |
| 4,306,718 | 12/1981 | Goeders | 273/25 |
| 4,341,836 | 7/1982 | Becker | 428/423.9 |
| 4,389,434 | 6/1983 | Polman | 428/17 |
| 4,396,653 | 8/1983 | Tomarin | 428/17 |
| 4,557,475 | 12/1985 | Donovan | 428/17 |

FOREIGN PATENT DOCUMENTS

| | | | |
|---|---|---|---|
| 0165895 | 10/1985 | European Pat. Off. | 428/17 |
| 2758696 | 7/1979 | Fed. Rep. of Germany | 428/17 |
| 3504821 | 8/1986 | Fed. Rep. of Germany | 428/423.9 |
| 861220 | 2/1961 | United Kingdom | 428/423.9 |

*Primary Examiner*—Ellis P. Robinson
*Assistant Examiner*—Donald J. Loney
*Attorney, Agent, or Firm*—Oblon, Fisher, Spivak, McClelland & Maier

[57] ABSTRACT

A batting box formed of a mixture of hard rubber crumb and a liquid resin binder.

8 Claims, 2 Drawing Sheets

BATTING BOX

FIELD OF THE INVENTION

This invention relates to batting boxes for use in playing baseball and softball.

BACKGROUND OF THE INVENTION

Conventional batting boxes are simply sections of ground marked off by chalk markings. Since batting boxes are used constantly, pits are quickly worn in the ground where the batters stand. These pits fill with rain water, turning the batting boxes into mud puddles.

Various attempts at producing artificial batting boxes have been made. However, in all such attempts known to the inventor, the materials of which the batting boxes are made are either unreasonably expensive, subject to rapid wear, or both. Accordingly, a major need has remained for a good, inexpensive, permanent batting box.

SUMMARY OF THE INVENTION

The batting box according to the invention comprises a panel formed of a mixture of hard rubber crumb and a liquid resin binder.

DETAILED DESCRIPTION OF THE PRESENTLY PREFERRED EMBODIMENT

A batting box according to the invention comprises a panel 10 formed of a mixture of hard rubber crumb and a liquid resin binder. The hard rubber crumb is preferably a number 6 grade ground up tire and closed cell scrap rubber mixture. Such a mixture is available commerically from, e.g., Baker Rubber Inc. of South Bend, Ind. The liquid resin binder is preferably polyurethane, which is available from many commercial sources. The ratio of the mixture is preferably at least approximately 0.75 gallons of the liquid resin binder to 20 pounds of the hard rubber crumb. Thus, a typical four foot by eight foot panel one and one-half inches thick takes 120 pounds of the hard rubber crumb and 4.5 gallons of the liquid resin binder to produce.

Figure 1:
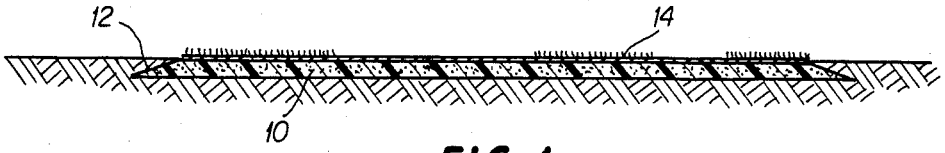
FIG. 1 is a cross-sectional view of a batting box according to the invention and a view along the line I—I in FIG. 4.
Figure 2:
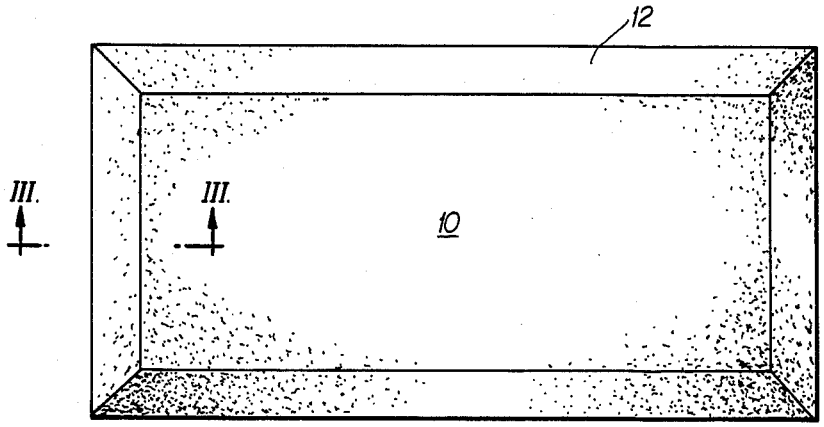
FIG. 2 is a plan view of a component of the batting box according to the invention.
Figure 3:
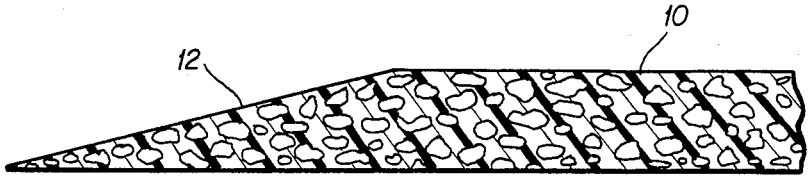
FIG. 3 is a view along the line III—III in FIG. 2 on an enlarged scale.
Figure 5:
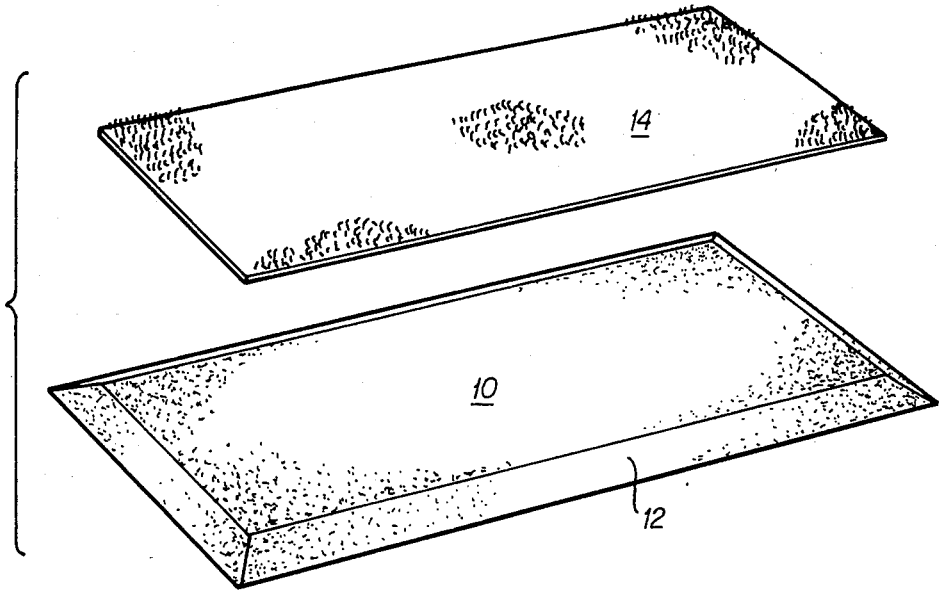
FIG. 5 is a perspective, disassembled view of a batting box according to the invention.
Figure 4:
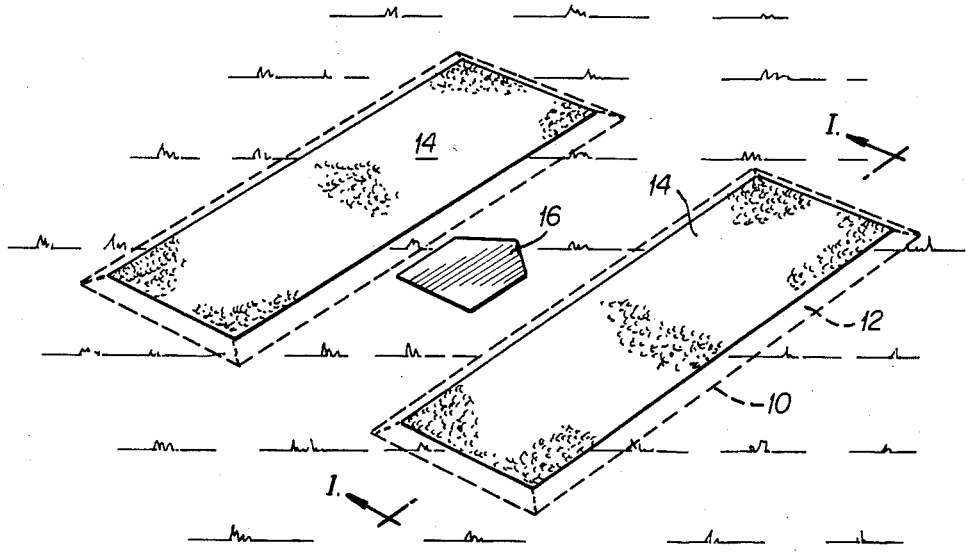
FIG. 4 is a perspective view of two batting boxes according to the invention in use.

The upper edge 12 of the panel 10 is preferably beveled (as best seen in FIG. 3) to minimize discontinuity between the batting box and the adjacent ground in which the batting box is buried as seen in FIG. 4. In the preferred embodiment, the panel 10 is eight feet by four feet in plan and one and one-half inches thick, and the bevel is six inches wide.

The batting box preferably also comprises a layer 14 of synthetic fiber turf on top of the panel 10. The layer 14 preferably comprises a polypropylene olefin fiber with graded sand infill. The polypropylene olefin fiber is preferably 1 inch in length, has a denier of 7600, and weighs 56 ounces per yard. Additionally, the layer 14 preferably has a urethane tuft lock backing.

The batting box can be made by pouring a homogeneous mixture of the hard rubber crumb and the liquid resin binder into a mold, then rolling the mixture with a 100 pound flexible roller for compactness. The panel 10 should then be allowed to set for 24 hours before removal from the mold. After removal from the mold, the panel 10 should be allowed to cure for an additional 48 hours before being covered with the layer 14 of synthetic fiber turf.

In use, a batting box is buried on each side of a home plate 16 as shown in FIG. 4.

CAVEAT

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A batting box comprising a panel:

(a) formed of a mixture of hard rubber crumb and a liquid resin binder and (b) that has a lower rectangular planar surface, an upper rectangular planar surface that is smaller than said lower rectangular planar surface, and four trapezoidal side surfaces each of which slants upwardly and inwardly from an edge of said lower rectangular planar surface to a corresponding edge of said upper rectangular planar surface, said four trapezoidal side surfaces serving to anchor said batting box in the ground and to prevent injury when a player slides into said batting box.

2. A batting box as recited in claim 1 wherein said hard rubber crumb is composed of a mixture of number 6 grade ground up tire and closed cell scrap rubber.

3. A batting box as recited in claim 1 wherein said liquid resin binder is polyurethane.

4. A batting box as recited in claim 1 wherein the ratio of said mixture is at least approximately 0.75 gallons of said liquid resin binder to 20 pounds of said hard rubber crumb.

5. A batting box as recited in claim 1 and further comprising a layer of synthetic fiber turf on top of said panel.

6. A batting box as recited in claim 5 wherein said synthetic fiber turf comprises polypropylene olefin fibers.

7. A batting box as recited in claim 6 wherein said polypropylene olefin fibers are 1 inch in length, 7600 in denier, and weigh 56 ounces per yard.

8. A batting box as recited in claim 5 wherein said synthetic fiber turf has a urethane tuft lock backing.

* * * * *